US008234891B2

(12) United States Patent
Dalton, Jr. et al.

(10) Patent No.: US 8,234,891 B2
(45) Date of Patent: Aug. 7, 2012

(54) COMBINATION CAM LOCK WITH IMPROVED COMBINATION CHANGE MODE

(75) Inventors: Robert E. Dalton, Jr., Mauldin, SC (US); David Banks, Simpsonville, SC (US)

(73) Assignee: CompX International Inc., Greenville, SC (US)

( * ) Notice: Subject to any disclaimer, the term of this patent is extended or adjusted under 35 U.S.C. 154(b) by 821 days.

(21) Appl. No.: 11/940,535

(22) Filed: Nov. 15, 2007

(65) Prior Publication Data

US 2008/0110216 A1 May 15, 2008

Related U.S. Application Data

(60) Provisional application No. 60/859,268, filed on Nov. 15, 2006.

(51) Int. Cl.
*E05B 37/00* (2006.01)

(52) U.S. Cl. ..... 70/21; 70/284; 70/285; 70/312; 70/492

(58) Field of Classification Search ..... 70/21, 284, 70/285, 312, DIG. 63, DIG. 71, 419, 492
See application file for complete search history.

(56) References Cited

U.S. PATENT DOCUMENTS

| | | | | |
|---|---|---|---|---|
| 3,633,388 | A * | 1/1972 | Atkinson | 70/80 |
| 3,837,189 | A * | 9/1974 | Atkinson | 70/21 |
| 4,114,408 | A * | 9/1978 | Gee | 70/128 |
| 4,885,923 | A * | 12/1989 | Nakai | 70/284 |
| 5,237,842 | A * | 8/1993 | Rasch et al. | 70/285 |
| 5,345,798 | A * | 9/1994 | Nakai | 70/284 |
| 6,539,761 | B2 | 4/2003 | Yang | |
| 6,598,434 | B2 * | 7/2003 | Yang | 70/213 |
| 6,708,534 | B1 | 3/2004 | Ruan | |
| 6,792,778 | B1 | 9/2004 | Chen | |
| 6,799,445 | B1 * | 10/2004 | Tsai | 70/30 |
| 6,955,069 | B2 * | 10/2005 | Segawa et al. | 70/208 |
| 6,997,023 | B1 | 2/2006 | Huang | |
| 7,104,092 | B2 | 9/2006 | Yu | |
| 7,121,123 | B2 | 10/2006 | Yu | |
| 7,415,853 | B2 * | 8/2008 | Yu | 70/68 |
| 7,444,844 | B1 * | 11/2008 | Lee | 70/21 |
| 7,614,266 | B2 * | 11/2009 | White et al. | 70/58 |
| 2006/0266084 | A1 * | 11/2006 | Kuo et al. | 70/21 |
| 2008/0060399 | A1 * | 3/2008 | Lee | 70/312 |
| 2008/0307838 | A1 * | 12/2008 | Hung | 70/284 |

* cited by examiner

*Primary Examiner* — Lloyd Gall
(74) *Attorney, Agent, or Firm* — Dority & Manning, P.A.

(57) ABSTRACT

Disclosed are apparatus and methodology for providing a resettable manual entry combination and key operated cam lock. Methodologies are provided for enabling changing of the manual entry resettable combination given knowledge of the previous combination and possession of an operable key. In alternative embodiments, provisions are made to prohibit forced opening of the lock by way of the use of foreign objects.

10 Claims, 4 Drawing Sheets

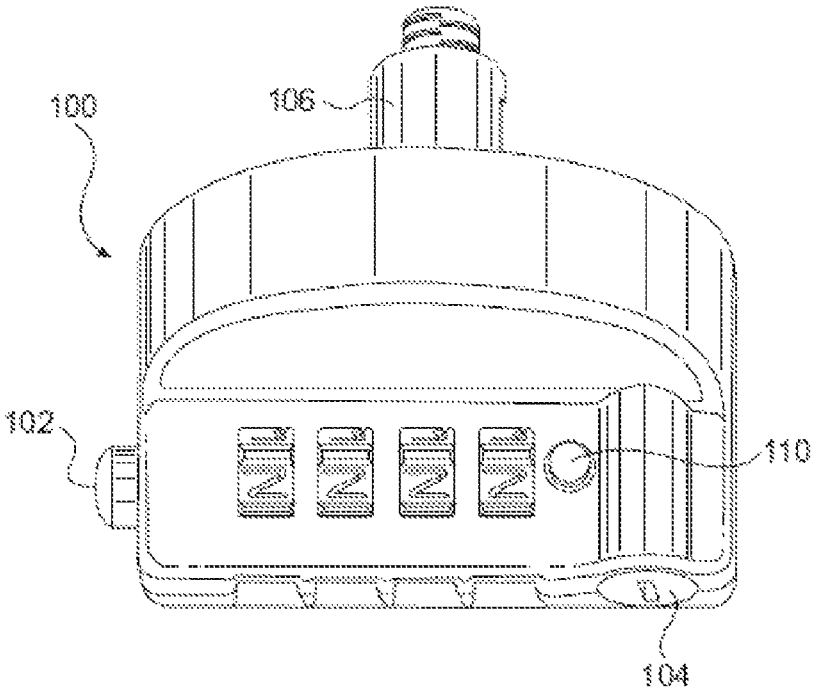
FIG. 1 - Prior Art
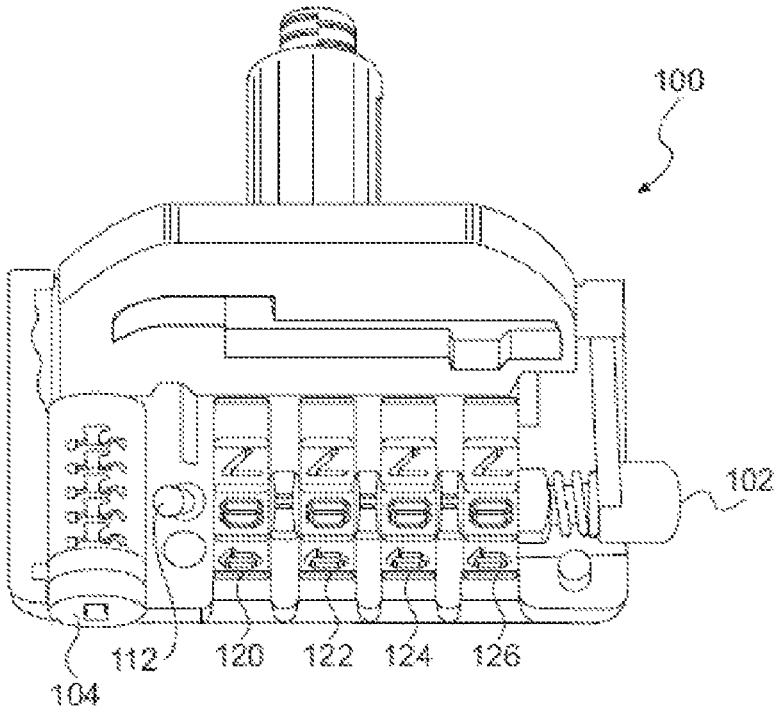
FIG. 2 - Prior Art

FIG. 3
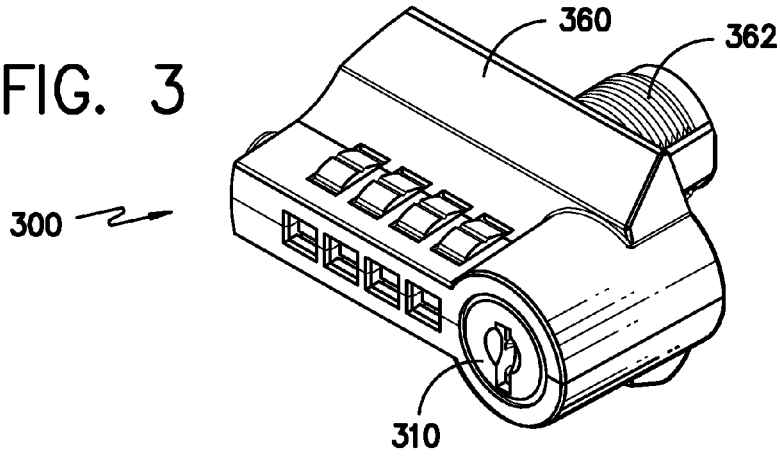
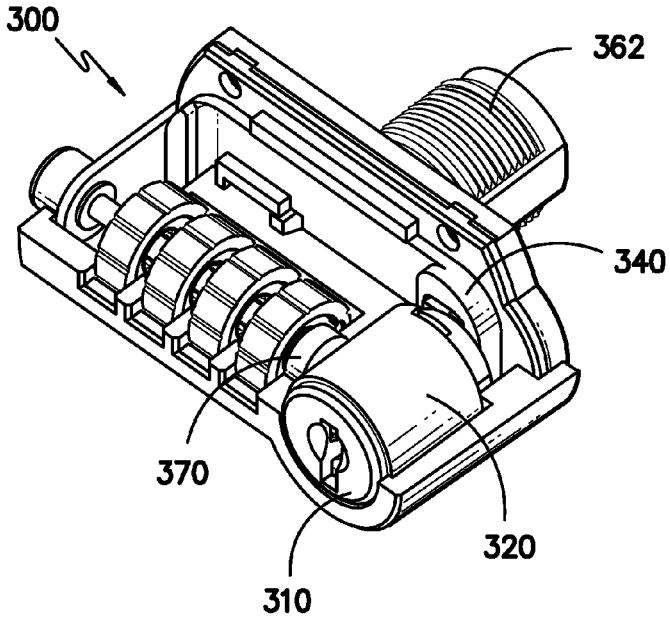
FIG. 4
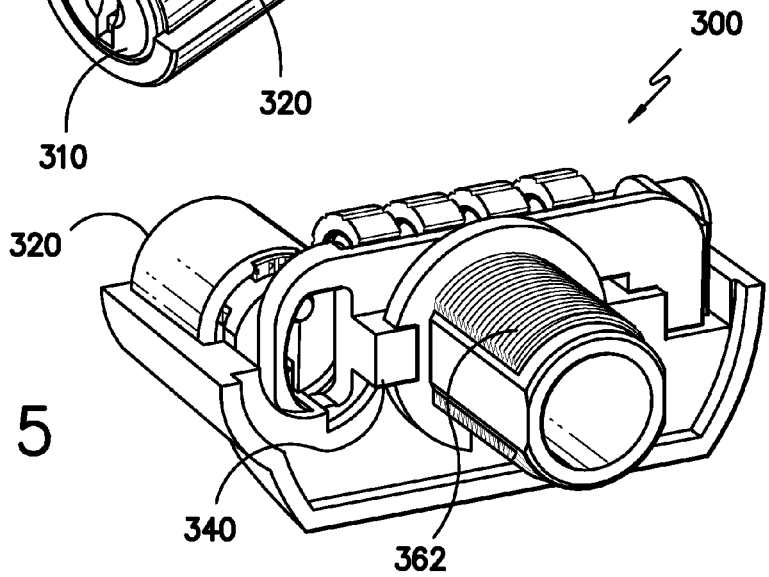
FIG. 5

COMBINATION CAM LOCK WITH IMPROVED COMBINATION CHANGE MODE

PRIORITY CLAIM

This application claims the benefit of previously filed U.S. Provisional Patent Application entitled "COMBINATION CAM LOCK WITH IMPROVED COMBINATION CHANGE MODE," assigned U.S. Ser. No. 60/859,268, filed Nov. 15, 2006, and which is incorporated herein by reference for all purposes.

FIELD OF THE INVENTION

The present subject matter relates to bi-modal operable locks, namely combination and key operated locks. More particularly, the present subject matter relates to resettable combination locks where knowledge of a current combination as well as possession of a key lock operating key are required to reset the lock combination.

BACKGROUND OF THE INVENTION

Combination and key operated locks have been previously provided in the art and may be employed in a variety of situations to secure enclosed areas or containers. Non-limiting examples may include lockers, rooms, lock boxes, desk drawers, electrical panels, and other similar enclosures. Such locks are convenient from the standpoint that access may be had to a secured item or area by either entering a combination such as by way of manually rotating combination setting elements associated with the lock or by inserting a key into the lock.

Prior United States patents include reference to prior combination and key operated locks. For example, U.S. Pat. No. 6,539,761 to Yang is entitled "Padlock by combining key-operated lock and combination lock" and relates to a padlock which includes a lock body; a shackle operatively locked in or unlocked from the lock body; a key-operated locking device formed in the lock body for operatively unlocking the shackle for unlocking the padlock by using a key, and a combination locking device juxtapositionally formed in the lock body for operatively unlocking the shackle for unlocking the padlock merely by dialing the combination to an unlocking number. U.S. Pat. No. 6,708,534 to Ruan is entitled "Padlock" and relates to a padlock that comprises a shackle, a lock body, a lock cylinder assembly disposed at the middle portion in the lock body, and a combination lock assembly. Such padlock can be operated by either the key or the cipher. Also provided is a padlock having an interchangeable lock cylinder assembly.

Another prior patent is U.S. Pat. No. 6,792,778 by Chen, entitled "Combination lock" and relates to a combination lock comprising a tumbler wheel assembly, a backup locking assembly comprising a keyhole, a shaft, and an inner projection having a half circular section, a pivot assembly having a dog and an engagement member, a push button secured to the pivot assembly, a U-shaped shackle pivotably fastened at the lock housing, and an L-shaped resilient member. A correct combination of tumblers and a subsequent pressing of the push button will disengage the dog from a slot at one leg of the shackle and thus exert an elastic force of the resilient member on the leg for pushing the leg out of engagement with the lock. Should either the combination be forgotten or the combination be changed by another person, a turning of the shaft about 90 degrees by inserting a key into the keyhole will turn the projection and the engaged engagement member for releasing the dog.

U.S. Pat. No. 6,997,023 to Huang is entitled "Combined combination lock and padlock" and relates to a combined combination lock and padlock comprising a second shackle receiving hole including an inside slot at one leg of a shackle of steel rope for receiving a spring depressible block, a tumbler wheel assembly, a key turning assembly, a pivot assembly, a push button, and a U-shaped shackle. A correct combination of tumblers and a subsequent pressing of the push button will disengage a dog with the slot and thus expansion of the block will push the leg out of engagement with the lock. As also stated in U.S. Pat. No. 6,792,778 by Chen, should either the combination be forgotten or the combination be changed by another person, a turning of the shaft about 90 degrees by inserting a key into the keyhole will turn the projection and the engaged engagement member for releasing the dog.

U.S. Pat. No. 7,104,092 to Yu is entitled "Security lock with dual locking means" and concerns a security lock that can be unlocked by the owner of the security lock by dialing an unlocking number or by authorized security personals with a general key. The security lock mainly contains: a lock body, a plugging device, a controlling device, a securing mechanism, a restriction device, a first locking device and a second locking means. The lock body has a first channel and a second channel therein. The plugging device is pluggable into the first channel. The controlling device is slidably secured within the second channel. The securing mechanism is for securing or releasing the plugging device. The restriction device is slidably deposed within the second channel against the controlling device for controlling movement thereof. The first locking device is formed in the lock body for being engaged with or disengaged from the restriction device. The second locking device is formed in the lock body for rotating the restriction device to be disengaged from the first locking device.

U.S. Pat. No. 7,121,123, also to Yu, is entitled "Padlock" and concerns a padlock which comprises a lock body, a shackle, a combination locking device and a key locking device. The shackle is movable relative to the lock body between a locked position and an unlocked position. The combination and key locking devices are installed within the lock body respectively for controlling movements of the shackle. Additionally, the combination locking device has a frame for receiving a first end of the shackle and a combination unit connected to the frame, which is movable when the combination unit is unlock whereby a second end of the shackle is movable to the unlock position. Furthermore, the key locking device comprises a block unit for locking the first end of the shackle and a key unit connected to the block unit, which is movable when the key unit is unlocked by a key.

Depending on the particular use to which the foregoing general types of locks may be applied, it may be convenient or necessary to be able to change the combination for the lock.

In an exemplary known lock structure 100 as illustrated in present FIGS. 1 and 2, desired access may be had by either inserting a key into the lock or by entering a combination (such as by way of manually rotating combination setting elements). In order to change the combination in the exemplary known combination and key operated locks as illustrated herein in FIGS. 1 and 2, the currently configured combination must be used to unlock the assembly, with the combination thereafter changed. If the combination is known, the combination may be changed by use of a set screw 110 (FIG. 1) that may be rotated 90° to engage an actuator 112

(FIG. 2) to place the lock in a combination change mode. The combination cannot be changed with possession of a physical unlocking key. Set screw 110 is independent of a dead bolt mechanism that locks the panel cylinder 106 against the cam lock housing as well as independent of the keyplug 104. In this known arrangement, if the combination is not known and a user tries to change the combination using set screw 110, set screw 110 will partially rotate but will not allow the combination to be changed. In normal lock operation, the combination may be entered manually and the lock opened by actuation of button 102.

In light of these recognized deficiencies, there exists a need for a manual combination and key lock operated lock that provides an improved mechanism for resetting the manual combination.

While various implementations of combination and key operated locks have been developed, no design has emerged that generally encompasses all of the desired characteristics as hereafter presented in accordance with the present subject matter.

SUMMARY OF THE INVENTION

In view of the recognized features encountered in the prior art and addressed by the present subject matter, improved apparatus and methodology for permitting reset of a manually enterable lock combination in a manual or physical key operable cam lock have been developed.

In an exemplary configuration and practice of the present subject matter, possession of an appropriately keyed physical key is required to reset a manually enterable combination.

In one of its simpler forms, insertion and operation of a physical key together with entry of a previously configured manually enterable combination allows resetting of the manual enterable combination.

Another positive aspect of the present type of subject matter is that either a physical key or manually entered combination may be used to operate the lock.

In accordance with aspects of certain embodiments of the present subject matter, corresponding methodologies and devices are provided to prevent operation of a lock of the present subject matter due to forced rotation of the keyplug by foreign objects.

One present exemplary embodiment relates to a combination cam lock, comprising a manually operable lock portion, a key lock portion, and a combination change portion. Such manually operable lock portion is preferably configured to enable lock operation upon presentation thereto of a predetermined manual entry combination. Such key lock portion is preferably configured to enable lock operation upon actuation with a physical key, independently of any presentation of any manually entered combination to the manually operable lock portion. Still further, such combination change portion is preferably configured to permit resetting of the predetermined manual entry combination upon both presentation of the predetermined manual entry combination and actuation of the key lock portion with a physical key.

In a present exemplary method of operating a combination cam lock, a combination cam lock is provided having a manually operable combination entry portion operable to open the cam lock upon manual entry of a predetermined combination, and an independently operable physical key operable portion operable to open the cam lock upon rotation of the physical key to a first position thereof. Further in such exemplary method, manual entry is made of the predetermined combination to the manually operable portion so as to unlock the cam lock. Also, a physical key is inserted into the key operable portion, and thereafter such physical key is rotated to a position beyond the first position thereof. Further thereafter, manual entry components of the manually operable combination entry portion may be selectively repositioned, with the result that the predetermined combination may be reset to a new predetermined combination.

In yet another present exemplary methodology, a method of operating a combination cam lock may preferably comprise providing a combination cam lock having a manually operable combination entry portion operable to open the cam lock upon manual entry of a predetermined combination, and an independently operable physical key operable portion operable to open the cam lock upon rotation of the physical key to a first position, with both such portions contained within a housing; manually entering the predetermined combination to the manually operable portion so as to unlock the cam lock; inserting a physical key into the key operable portion, and rotating the physical key to the first position thereof; removing the physical key from the key operable portion; and selectively repositioning manual entry components of the manually operable combination entry portion. With practice of such methodology, the predetermined combination may be reset to a new predetermined combination.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures).

Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which:

FIG. 1 illustrates a known resettable combination and key operable lock structure;

FIG. 2 illustrates a partially broken away view of the known lock structure of FIG. 1;

FIG. 3 illustrates a generally front perspective view of a combination and key operable cam lock incorporating features of the present subject matter;

FIG. 4 illustrates a generally front perspective view (in at least partial breakaway view) of a combination and key operable cam lock incorporating features of the present subject matter;

FIG. 5 illustrates a generally rear perspective view (also in at least partial breakaway view) of a combination and key operable cam lock incorporating features of the present subject matter, as otherwise seen in present FIG. 4;

Figure 6:
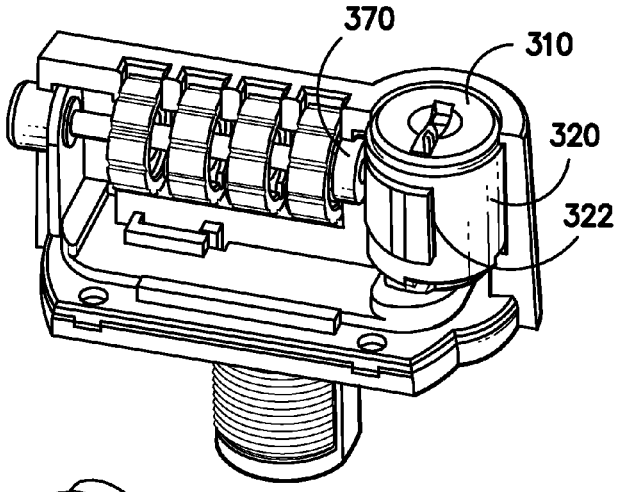
FIG. 6 is a perspective view of a combination and key lock illustrating possible unintended operation.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with an improved methodology for permitting reset of a manually enterable lock combination in a manual combination or physical key operated cam lock.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Referring now to the drawings, FIGS. 1 and 2 (each respectively marked as "Prior Art") illustrate a known resettable combination and key operable lock structure 100 and a partially broken away view of the lock structure, respectively, as previously described. Such known configuration requires knowledge of the previously set manually enterable lock combination before the combination can be reset regardless of possession of a physical unlocking key. Depending upon the use to which the lock is applied, as previously described, it may not be preferable for possessors of the manually enterable combination to be able to change the combination simply by operation of set screw 110.

Reference will now be made in detail to presently preferred exemplary embodiments of the subject combination cam lock.

With reference to FIG. 3, there is illustrated a perspective view of a combination and key operable cam lock 300 incorporating features of the present subject matter and illustrating a fully assembled device. As may be seen, cam lock housing 360 contains therein a keyplug 310. Cam lock housing 360 may be secured to an item to be protected by way of panel cylinder 362.

FIGS. 4 and 5, respectively, illustrate front and rear perspective breakaway views of a cam lock 300 constructed in accordance with a first exemplary embodiment of the present subject matter. In accordance with the present subject matter, knowledge of the previously assigned combination as well as possession of a lock operating key are required to change the combination. The lock operating key may be individually keyed to cam lock 300 or may be a master key for use with a series of similar cam locks. In either circumstance, the key or the combination respectively may be used individually to unlock the assembly.

In accordance with the present subject matter, in order to change the lock combination, insertion of a correct key into keyplug 310 together with knowledge of the current combination is required. As a correct key is inserted into keyplug 310 and rotated 90° clockwise (CW), keyplug 310 turns inside the inner cylinder 320 that encapsulates keyplug 310 and activates a lock plate 340. Activation of lock plate 340 releases cam lock housing 360 from panel cylinder 362, thereby unlocking the assembly and allowing the assembly to be rotated 90° CW to an unlatched position.

Detent actuator 370 (FIGS. 4 and 6) prevents inner cylinder 320 from rotating when keyplug 310 is rotated to the unlocked position. In the unlocked position, and if the combination is known and the correct key is inserted into the keyplug 310 and rotated an additional 90° CW, the keyplug 310 rotation stop engages the inner cylinder 320 which rotates inside the cam lock housing 360 with a cam action 322 (FIG. 6) to place the assembly in a combination change mode.

When keyplug 310 and the combination are in a locked position, it could be possible to partially rotate keyplug 310 by inserting a foreign object into keyplug 310. Even though such activity would be unauthorized (i.e., unintended under ordinary, authorized use) such partial rotation could permit the tumblers in keyplug 310 to engage inner cylinder 320 and to rotate the inner cylinder 320 and keyplug 310 towards the combination change mode position. Such rotation could engage and sufficiently activate lock plate 340 so as to disengage from panel cylinder 362, thus unlocking the assembly.

Figure 7:
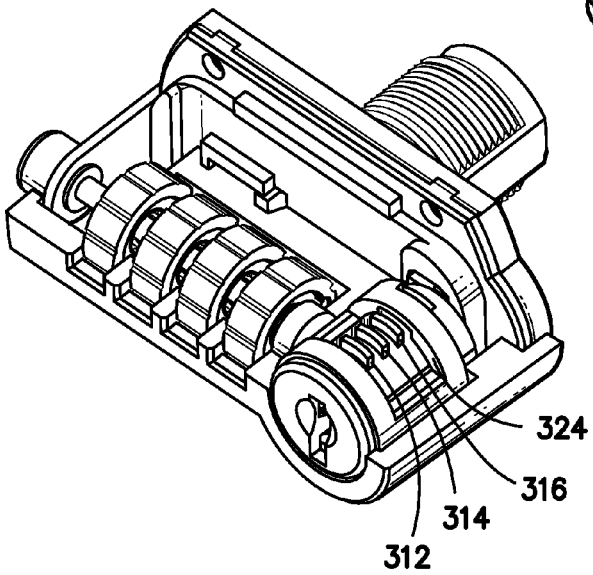
FIG. 7 illustrates a generally front perspective view (in at least partial breakaway view) of a combination and key lock incorporating features of an additional exemplary embodiment of the present subject matter, including features prohibiting unintended lock operation.
Figure 8:
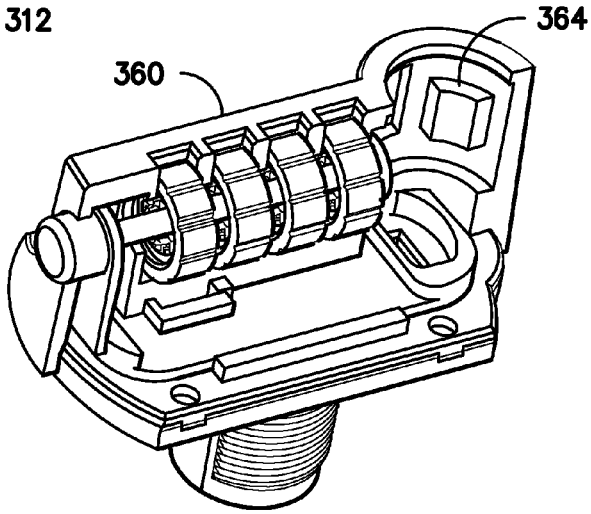
FIG. 8 illustrates a generally rear and side perspective view (also in at least partial breakaway view) of a combination and key lock incorporating features of an additional exemplary embodiment of the present subject matter including features prohibiting unintended lock operation, as otherwise seen in present FIG. 7.

With reference now to FIGS. 7 and 8, it will be seen that, in accordance with an additional embodiment of the present subject matter, measures have been provided to address such potential unauthorized methodology for unintended access to the cam lock mechanism.

With specific and collective reference to FIGS. 7 and 8, it will be observed that inner cylinder 320 has been formed with a cut out region 324 (see FIG. 7), and the cam lock housing 360 has been provided a protrusion 364 (see FIG. 8). The provision of cut out region 324 allows three of the five keyplug tumblers 312, 314, and 316, to lock against the cam lock housing 360 instead of against the inner cylinder 320. As will be understood by those of ordinary skill in the art, by such present arrangement, tumblers one and five (not visible in the drawing) will lock against inner cylinder 320 while tumblers 312, 314, and 316 will lock against protrusion 364 of cam lock housing 360. Inner cylinder cut out 324 and cam lock housing protrusion 364 may be configured so as to allow inner cylinder 320 to rotate 90° CW and back 90° CounterClockwise (CCW). The inner cylinder cutout region 324 and the cam lock housing protrusion 364 are sufficient to prevent the keyplug and inner cylinder from being partially rotated with a foreign object toward combination change mode, thus maintaining the engagement between the lock plate 340 and the panel cylinder 362 and also maintaining the security of the cam lock assembly.

Figure 9:
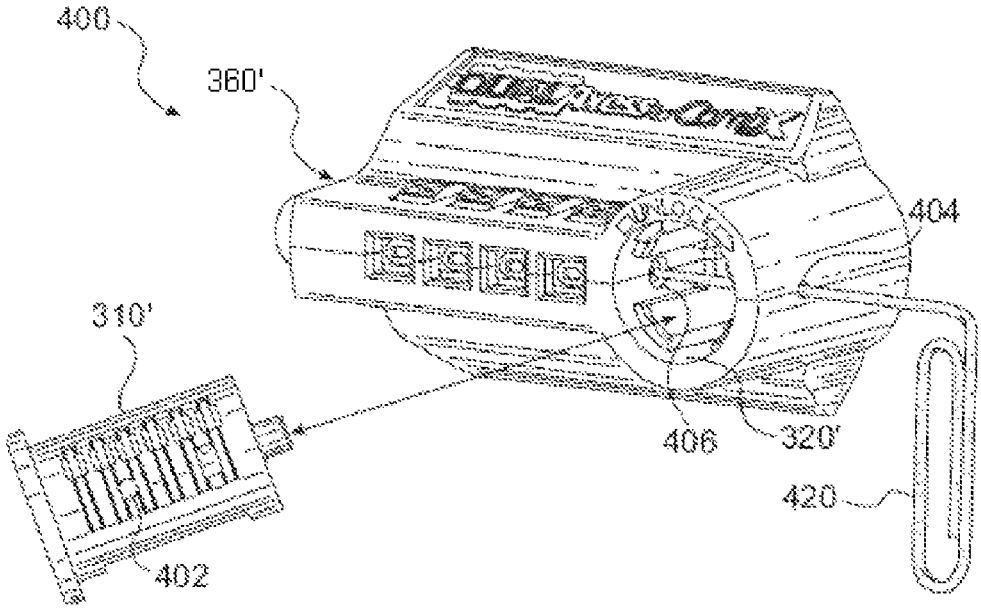
FIG. 9 illustrates a partially exploded view of another exemplary embodiment of the present subject matter.
Figure 10:
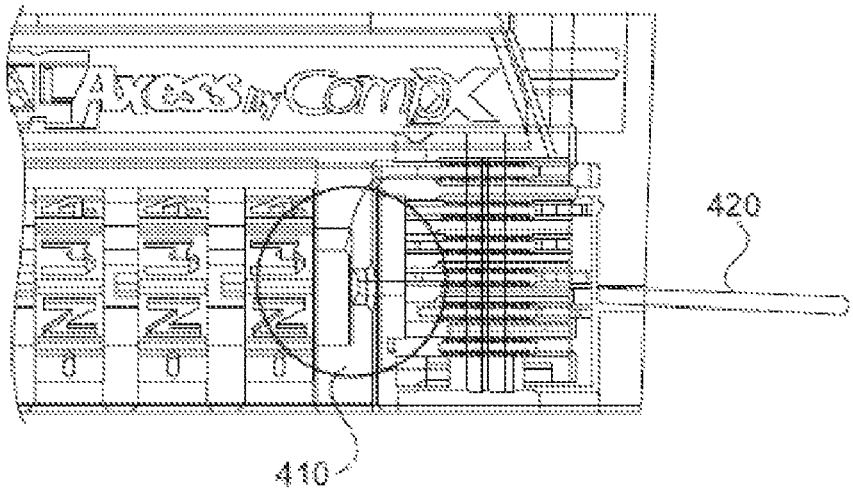
FIG. 10 illustrates a partial see-through view of a portion of the exemplary embodiment illustrated in FIG. 9.

With reference to FIGS. 9 and 10, a further exemplary embodiment of a combination cam lock generally 400 in accordance with the present subject matter is described. Such further second embodiment provides for resetting the combination of the combination cam lock generally 400 and still advantageously per present subject matter requires both knowledge of the current (or existing) combination and possession of a physical key.

With reference to FIG. 9, it will be noticed that combination cam lock 400 includes a housing 360' including a portion 320' that has been redesigned to accept keyplug 310' directly without having to provide an inner cylinder (such as inner cylinder 320 of FIGS. 4 and 5). Further, keyplug 310', while otherwise generally equivalent to keyplug 310 of the previous embodiment, is provided with a through hole 402 that passes entirely through keyplug 310'. In the illustrated embodiment, through hole 402 passes through keyplug 310' in approximate parallel alignment between a second and third tumbler. It should be appreciated that such positioning is exemplary only and may be varied depending on positional requirements with cam lock 400, for given embodiments thereof. In other words, those of ordinary skill in the art may within the spirit and scope of the present subject matter selectively position such through hole 402 in accordance with the needs or desires of particular implementations.

With further reference to FIG. 9, it will be seen that cam lock housing 360' is provided with a side hole or opening 404 and a combination change mechanism opening 406 substantially aligned with side hole 404. Such arrangement is configured so that when keyplug 310' is in place within inner cylinder equivalent space 320' of housing 360', and the lock is unlocked by use of a physical key, keyplug 310' may be rotated 90° from its normal locked position such that keyplug hole 402, side hole 404, and combination change mechanism opening 406 are in alignment with each other.

To reset the manual entry combination in the first embodiment of the present subject matter, the correct combination must be set so as to unlock the assembly and a key must be inserted into the keyplug and rotated 180° to activate the inner cylinder 320 (FIGS. 4 and 5) and to place the assembly in "combination change mode". In the present embodiment, the inner cylinder 320 per se has been eliminated and the assembly housing modified to directly accept keyplug 310' (FIG. 9). In accordance with such further embodiment of the present subject matter, the correct (i.e., existing) combination must be set to unlock the assembly and a key must be inserted into the keyplug 310' and rotated 90° Clockwise to the unlocked position. Maximum keyplug rotation for such further embodiment is 90°.

With the key removed from keyplug 310', a tool such as a large paper clip 420 may then be inserted into side hole 404 (FIG. 9), and through through hole 402 of keyplug 310', and then into combination change mechanism opening 406 that has been provided to expose the combination change mechanism illustrated generally within circle 410 of FIG. 10. Pushing the combination change mechanism with the tool, allows the combination to be reset. Disengaging the tool from the combination change mechanism sets the new combination. The key may then be reinserted and rotated 90° Counterclockwise to lock the assembly.

It should be appreciated by those of ordinary skill in the art that the keyplug may be provided with any suitable number of tumblers and that the example here illustrated involving three of five tumblers is purely illustrative of the present subject matter, and that different numbers of tumblers (both total and protectively locked) may be alternatively practiced within the broader scope of present aspects of the present subject matter.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A combination cam lock, comprising:

a manually operable lock portion configured to enable lock operation upon presentation thereto of a predetermined manual entry combination; and a key lock portion configured to enable lock operation upon actuation with a physical key, independently of any presentation of any manually entered combination to said manually operable lock portion, wherein resetting of said predetermined manual entry combination requires both presentation of said predetermined manual entry combination and actuation of said key lock portion with a physical key.

2. The combination cam lock of claim 1, wherein said key lock portion comprises a keyplug fitted within a housing, whereby insertion of a physical key into said keyplug and rotation of said keyplug to a first position thereof permits unlocking of said cam lock.

3. A combination cam lock, comprising:

a manually operable lock portion configured to enable lock operation upon presentation thereto of a predetermined manual entry combination;

a key lock portion configured to enable lock operation upon actuation with a physical key, independently of any presentation of any manually entered combination to said manually operable lock portion, said key lock portion comprising a keyplug fitted within a housing, so that insertion of a physical key into said keyplug and rotation of said keyplug to a first position thereof permits unlocking of said cam lock;

a detent actuator associated with said manually operable lock portion;

a first through hole positioned in said housing in alignment with said detent actuator; and a second through hole positioned in said keyplug, whereby rotation of said keyplug to said first position thereof and removal of said physical key from said keyplug permits unimpeded alignment of said first through hole, said second through hole, and said detent actuator, thereby providing external access to said detent actuator;

wherein resetting of said predetermined manual entry combination requires both presentation of said predetermined manual entry combination and actuation of said key lock portion with a physical key.

4. A method of operating a combination cam lock, comprising:

providing a combination cam lock having a manually operable combination entry portion operable to open the cam lock upon manual entry of a predetermined combination, and an independently operable physical key operable portion operable to open the cam lock upon rotation of the physical key to a first position thereof;

manually entering the predetermined combination to the manually operable portion so as to unlock the cam lock;

inserting a physical key into the key operable portion;

rotating the physical key to a position beyond the first position thereof; and selectively repositioning manual entry components of the manually operable combination entry portion, whereby the predetermined combination may be reset to a new predetermined combination.

5. A method of operating a combination cam lock, comprising:

providing a combination cam lock having a manually operable combination entry portion operable to open the cam lock upon manual entry of a predetermined combination, and an independently operable physical key operable portion operable to open the cam lock upon rotation of the physical key to a first position, with both such portions contained within a housing;

providing the housing with a first through hole;

providing the key operable portion with a second through hole;

manually entering the predetermined combination to the manually operable portion so as to unlock the cam lock;

inserting a physical key into the key operable portion;

rotating the physical key to the first position thereof;

removing the physical key from the key operable portion;

inserting a combination change enabling device through the first and second through holes; and selectively repositioning manual entry components of the manually operable combination entry portion, whereby the predetermined combination may be reset to a new predetermined combination.

6. A combination cam lock, comprising:

a manually operable lock portion configured to enable lock operation upon presentation thereto of a predetermined manual entry combination;

a key lock portion configured to enable lock operation upon actuation with a physical key, independently of any presentation of any manually entered combination to said manually operable lock portion, said key lock portion having an inner cylinder forming an opening positioned in a portion thereof; and a housing with a protrusion positioned in a portion thereof such that said opening and said protrusion operatively cooperate to inhibit resetting of said predetermined manual entry combination until said key lock portion is actuated by a physical key so that resetting of said predetermined manual entry combination requires both presentation of said predetermined manual entry combination and actuation of said key lock portion with a physical key.

7. The combination cam lock of claim 6, wherein said key lock portion further includes a keyplug fitted within said inner cylinder, whereby insertion of a physical key into said keyplug and rotation of said keyplug to a first position thereof permits unlocking of said cam lock.

8. The combination cam lock of claim 7, wherein:

said housing encloses said manually operable lock portion and said key lock portion; and said opening and said protrusion operatively cooperate with tumblers of said keyplug to inhibit resetting of said predetermined manual entry combination until said key lock portion is actuated by a physical key.

9. The combination cam lock of claim 7, further comprising:

a detent actuator associated with said manually operable lock portion, wherein said detent actuator is configured to inhibit rotation of said inner cylinder while said manually operable lock portion is positioned in a locked configuration thereof.

10. The combination cam lock of claim 9, wherein said detent actuator is configured to permit rotation of said inner cylinder to a second position thereof upon presentation to said manually operable lock portion of said predetermined manual entry combination, whereby said predetermined manual entry combination may be reset.

* * * * *